US009775400B2

(12) United States Patent
Chang et al.

(10) Patent No.: US 9,775,400 B2
(45) Date of Patent: Oct. 3, 2017

(54) FOOT ARCH SUPPORT DEVICE

(71) Applicant: Big Hill Industrial Co., Ltd., New Taipei (TW)

(72) Inventors: Chia-Wei Chang, New Taipei (TW); Yu-Ju Chen, New Taipei (TW)

(73) Assignee: Big Hill Industrial Co., Ltd., New Taipei (TW)

( * ) Notice: Subject to any disclaimer, the term of this patent is extended or adjusted under 35 U.S.C. 154(b) by 9 days.

(21) Appl. No.: 15/083,368

(22) Filed: Mar. 29, 2016

(65) Prior Publication Data

US 2017/0119090 A1 May 4, 2017

(30) Foreign Application Priority Data

Nov. 4, 2015 (TW) ..... 104217615 U

(51) Int. Cl.

| | |
|---|---|
| ***A43B 3/24*** | (2006.01) |
| ***A43B 7/14*** | (2006.01) |
| ***A43B 13/12*** | (2006.01) |
| ***A43B 21/42*** | (2006.01) |

(52) U.S. Cl.

CPC ..... *A43B 7/1445* (2013.01); *A43B 3/246* (2013.01); *A43B 7/141* (2013.01); *A43B 13/122* (2013.01); *A43B 21/42* (2013.01)

(58) Field of Classification Search

CPC ..... A43B 3/246; A43B 7/14; A43B 7/142; A43B 13/122; A43B 21/433; A43B 21/42

USPC ..... 36/42, 91, 100, 150, 151, 155–160, 171

See application file for complete search history.

(56) References Cited

U.S. PATENT DOCUMENTS

| | | | | | |
|---|---|---|---|---|---|
| 1,644,762 | A * | 10/1927 | Voll | A43B 7/1465 | 36/157 |
| 2,258,265 | A * | 10/1941 | Schwartz | A43B 21/433 | 36/100 |
| 2,779,110 | A * | 1/1957 | Howell | A43B 7/1465 | 36/156 |
| 5,519,950 | A * | 5/1996 | Wang | A43B 21/40 | 36/36 R |
| 7,140,125 | B2 * | 11/2006 | Singleton | A43B 7/14 | 36/152 |
| 7,185,448 | B2 * | 3/2007 | Schupbach | A43B 3/24 | 36/100 |
| 8,832,972 | B2 * | 9/2014 | Kemp | A43B 3/24 | 36/100 |
| 9,289,025 | B2 * | 3/2016 | Damodar | A43B 3/246 | |
| 2005/0081401 | A1 * | 4/2005 | Singleton | A43B 7/14 | 36/34 R |

(Continued)

*Primary Examiner* — Marie Bays

(74) *Attorney, Agent, or Firm* — Trop Pruner & Hu, P.C.

(57) ABSTRACT

A foot arch support device includes a base seat, a movable unit, high and low heel members, and an actuating unit. The base seat includes a first base plate. The movable unit includes a movable plate that is movable relative to the first base plate between high and low curvature positions. When the low heel member is coupled to the base seat, the movable plate is at the low curvature position. When the high heel member is coupled to the base seat, a support part of the high heel member abuts against the movable plate, and the movable plate is pushed by the high heel member to the high curvature position. The actuating unit is operable for permitting removal of a selected one of the high and low heel members from the base seat.

10 Claims, 6 Drawing Sheets

(56) References Cited

U.S. PATENT DOCUMENTS

| | | | | |
|---|---|---|---|---|
| 2010/0083537 | A1* | 4/2010 | Wierda | A43B 3/24 36/100 |
| 2011/0119954 | A1* | 5/2011 | Ortiz | A43B 21/39 36/42 |
| 2013/0247412 | A1* | 9/2013 | Du Coeur | A43B 21/36 36/42 |
| 2014/0298685 | A1* | 10/2014 | Alan | A43B 3/246 36/100 |

* cited by examiner

FOOT ARCH SUPPORT DEVICE

CROSS-REFERENCE TO RELATED APPLICATION

This application claims priority of Taiwanese Application No. 104217615, filed on Nov. 4, 2015.

FIELD

The disclosure relates to a support device, more particularly to a support device adapted to be connected to a shoe, and that is able to support a user's foot arch according to different heel heights.

BACKGROUND

Taiwanese Patent No. I1495436 discloses a shoe having height-adjustable heels that can be adapted by a user to different requirements. However, the user may feel uncomfortable wearing the shoe without the user's foot arch being appropriately supported according to different heel heights.

SUMMARY

Therefore, an object of the disclosure is to provide a foot arch support device for a shoe that is able to appropriately support a user's foot arch according to different heel heights so as to improve the comfort of the user when wearing the shoe.

According to the present disclosure, a foot arch support device is adapted to be connected to a bottom of a shoe. The shoe has a heel portion, a toe portion, and an arch portion that is between the heel portion and the toe portion. The foot arch support device includes a base seat, a movable unit, a heel unit and an actuating unit. The base seat includes a first base plate, and a second base plate disposed under the first base plate and that is adapted to be adjacent to the heel portion of the shoe. The first base plate has a top surface that is opposite to the second base plate. The movable unit includes a movable plate that is connected to the first base plate, that has an abutment surface facing the top surface of the first base plate, and that is movable relative to the first base plate between a high curvature position, where the abutment surface is away from the top surface of the first base plate, and a low curvature position, where the abutment surface abuts against the top surface of the first base plate. The heel unit includes a high heel member and a low heel member. A selected one of the high heel member and the low heel member is removably coupled to a bottom of the base seat, and has a heel part, and a support part that extends from a top end of the heel part and that has a top end face.

When the low heel member is coupled to the bottom of the base seat, the movable plate of the movable unit is at the low curvature position. When the high heel member is coupled to the bottom of the base seat, the top end face of the support part of the high heel member abuts against the abutment surface of the movable plate, and the movable plate is pushed by the support part of the high heel member to the high curvature position. The actuating unit is disposed on the base seat, is adapted to be adjacent to the heel portion of the shoe, and is operable for permitting removal of the selected one of the high heel member and the low heel member from the bottom of the base seat.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
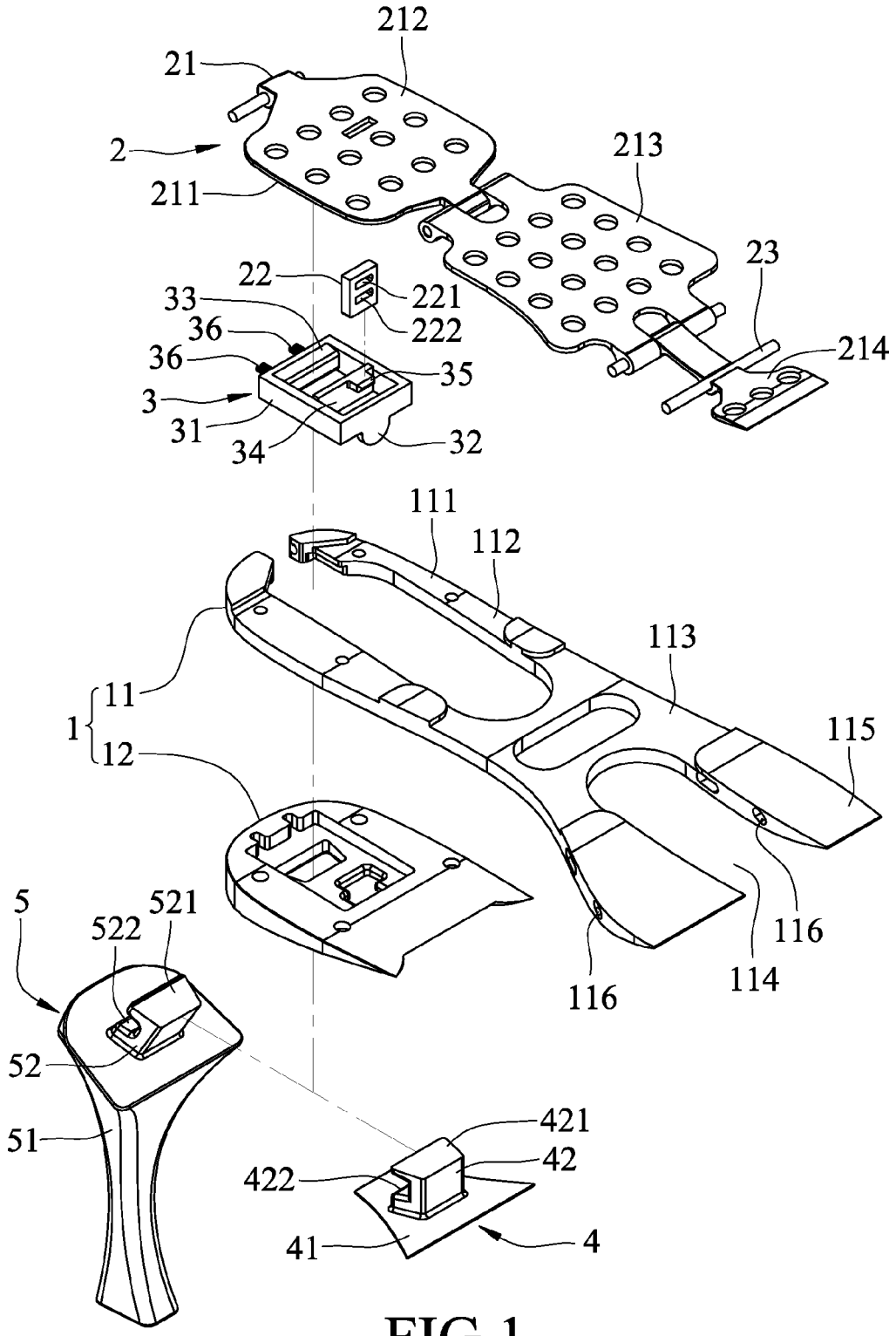
FIG. 1 is an exploded perspective view of an embodiment of a foot arch support device according to the disclosure.
Figure 2:
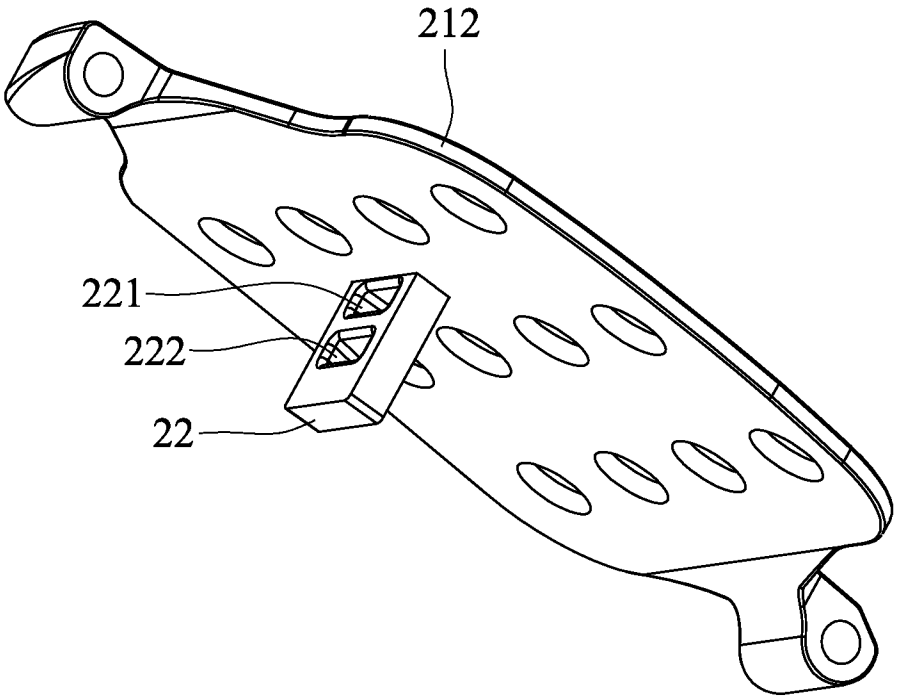
FIG. 2 is a perspective view illustrating a positioning member and a heel segment of a movable plate of the embodiment.
Figure 3:
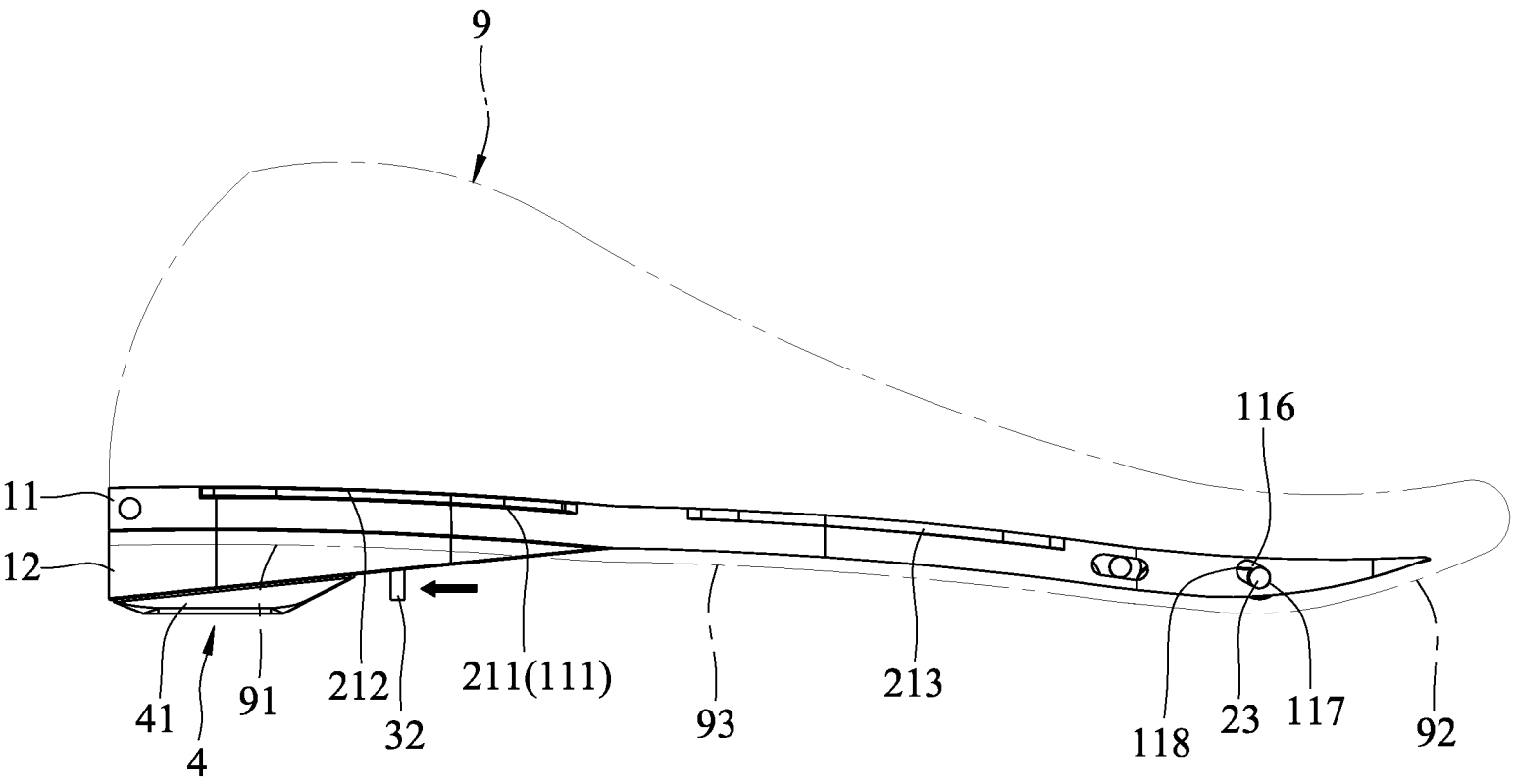
FIG. 3 is a fragmentary side view of the embodiment, illustrating the movable plate at a low curvature position.

As shown in FIGS. 1 to 4, the embodiment of the foot arch support device according to the present disclosure is adapted to be connected to a bottom of a shoe 9 (see FIG. 3). The shoe 9 has a heel portion 91, a toe portion 92, and an arch portion 93 between the heel portion 91 and the toe portion 92.

The foot arch support device includes a base seat 1, a movable unit 2, an actuating unit 3, and a heel unit that is removably coupled to a bottom of the base seat 1. The heel unit includes a low heel member 4 and a high heel member 5.

The base seat 1 includes a first base plate 11, and a second base plate 12 that is disposed under the first base plate 11, and that is adapted to be adjacent to the heel portion 91. The first base plate 11 has a first recessed portion 112, a second recessed portion 113, and a front end portion 115 that are sequentially arranged toward a front end of the first base plate 11. The first recessed portion 112 has a top surface 111 opposite to the second base plate 12. The front end portion 115 is formed with a U-shaped opening 114, and two through holes 116 that are in spatial communication with the U-shaped opening 114. Each of the through holes 116 has opposite front and rear ends 117, 118 (see FIG. 3).

The movable unit 2 includes a movable plate 21 that is connected to the first plate 11, a positioning member 22 that is mounted to the movable plate 21, and a pivot shaft 23.

The movable plate 21 has an abutment surface 211 that faces the top surface 111 of the first base plate 11. The movable plate 21 further has a heel segment 212, an arch segment 213, and a toe segment 214 that are sequentially arranged toward a front end of the movable plate 21. The arch segment 213 pivotally interconnects the heel segment 212 and the toe segment 214. The toe segment 214 is received in the U-shaped opening 114 of the front end portion 115 of the first base plate 11. The pivot shaft 23 extends movably through the toe segment 214, and has opposite ends extending respectively into the through holes 116.

The movable plate 21 is movable relative to the first base plate 11 between a high curvature position (see FIG. 5), where the abutment surface 211 of the movable plate 21 is away from the top surface 111 of the first base plate 11, and a low curvature position (see FIG. 3), where the abutment surface 211 of the movable plate 21 abuts against the top surface 111 of the first base plate 11.

The positioning member 22 of the movable unit 2 is mounted to the heel segment 212 of the movable plate 21, and is formed with a first positioning hole 221 and a second positioning hole 222 arranged in a direction away from the heel segment 212, as shown in FIG. 2. It should be noted that, while the positioning member 22 is exemplified in this embodiment as being fitted into a hole in the heel segment 212 of the movable plate 21, the positioning member 22 may alternatively be welded to the toe segment 212 of the movable plate 21, or the positioning member 22 and the toe segment 212 may be formed as one piece in other embodiments.

The actuating unit 3 is disposed on the base seat 1 and is adjacent to the heel portion 91 of the shoe 9. The actuating unit 3 is operable for permitting removal of a selected one of the high heel member 5 and the low heel member 4 from the bottom of the base seat 1.

In this embodiment, the actuating unit 3 is disposed movably in the second base plate 12. The actuating unit 3 has a frame body 31, an actuating member 32, extending from a bottom end of the frame body 31 through the second base plate 12, a protrusion 33 connected to the frame body 31 and protruding forwardly, a spacer member 34 having opposite ends that are connected to an inner surface of the frame body 31, an engaging member 35 protruding from the spacer member 34, and two resilient members 36 connected between the second base plate 12 and the frame body 31. The engaging member 35 is removably engageable with one of the first positioning hole 221 and the second positioning hole 222.

In this embodiment, each of the resilient members 36 is a spring. The number of the resilient members 36 may vary in other embodiments.

Each of the low heel member 4 and the high heel member 5 has a heel part 41, 51, and a support part 42, 52 extending from a top end of the heel part 41, 51. Each of the support part 42, 52 has a top end face 421, 521, and a coupling groove 422, 522 that opens rearwardly. The support part 42 of the low heel member 4 has a height smaller than that of the support part 52 of the high heel member 5. A distance between the coupling groove 422 and the top end face 421 of the support part 42 of the low heel member 4 is smaller than that between the coupling groove 522 and the top end face 521 of the support part 52 of the high heel member 5.

Figure 4:
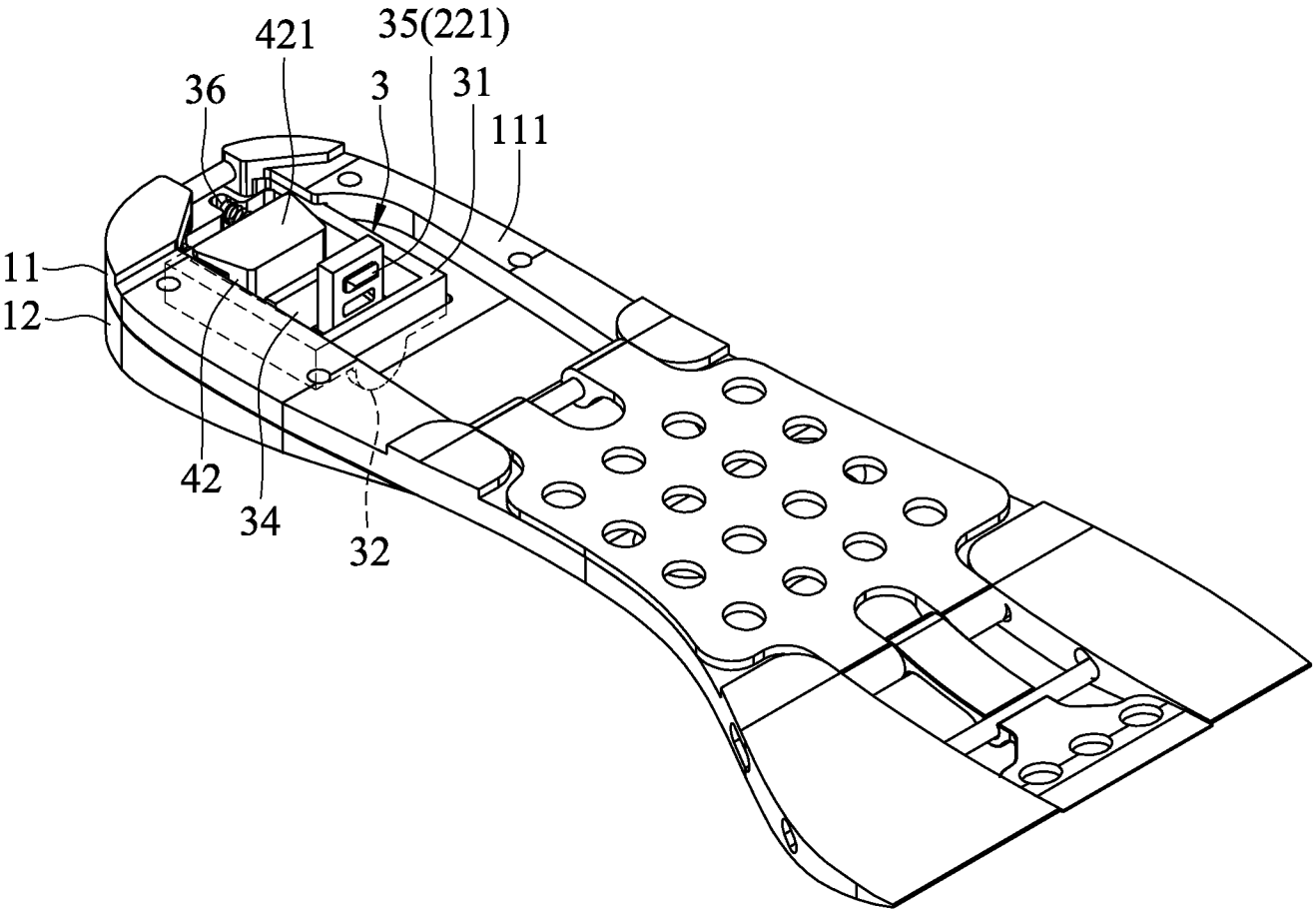
FIG. 4 is a fragmentary perspective view of the embodiment, illustrating an engaging member of an actuating unit of the embodiment engaging a first positioning hole of the positioning member.

In use, as shown in FIGS. 3 and 4, when a user selects the low heel member 4 and couples the low heel member 4 to the bottom of the base seat 1, the movable plate 21 is at the low curvature position, where the engaging member 35 engages removably the first positioning hole 221, where the top end face 421 of the support part 42 of the low heel member 4 is disposed below the top surface 111 of the first base plate 11, where the protrusion 33 engages removably the coupling groove 422 of the low heel member 4, and where the pivot shaft 23 abuts against the front ends 117 of the through holes 116. At this time, the heel segment 212 and the arch segment 213 of the movable plate 21 engage fittingly and respectively the first recessed portion 112 and the second recessed portion 113 of the first base plate 11.

When intending to remove the low heel member 4 and install the high heel member 5, the user first needs to push the actuating member 32 in a direction away from the toe portion 92 (as indicated by the arrow in FIG. 3) against resilient forces of the resilient members 36, so that the engaging member 35 of the actuating unit 3 is disengaged from the first positioning hole 221 of the positioning member 22, and that the protrusion 33 is also disengaged from the coupling groove 422 of the low heel member 4, thereby permitting the low heel member 4 to be separated from the shoe 9.

Figure 5:
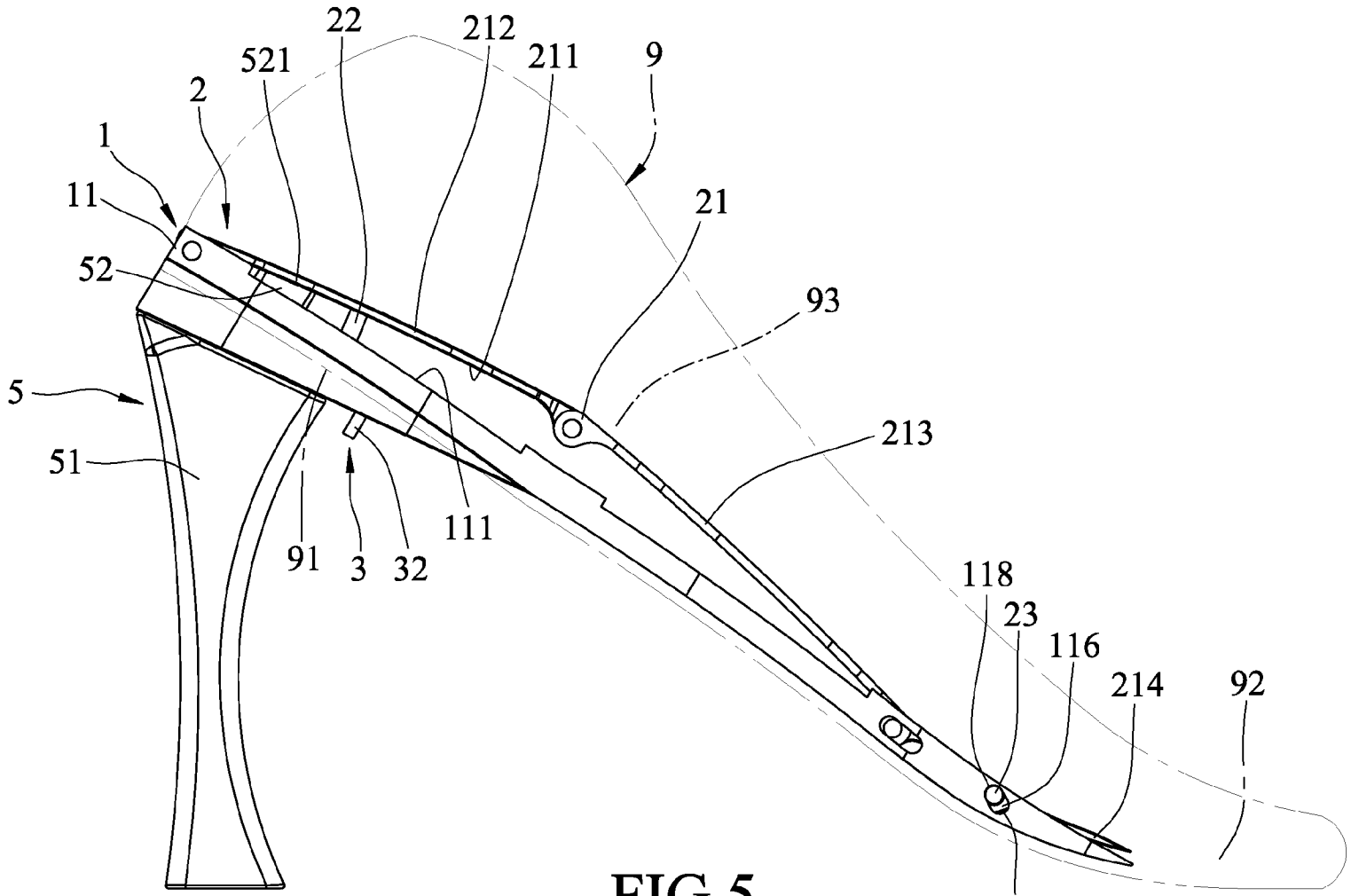
FIG. 5 is a fragmentary side view of the embodiment, illustrating the movable plate at a high curvature position.
Figure 6:
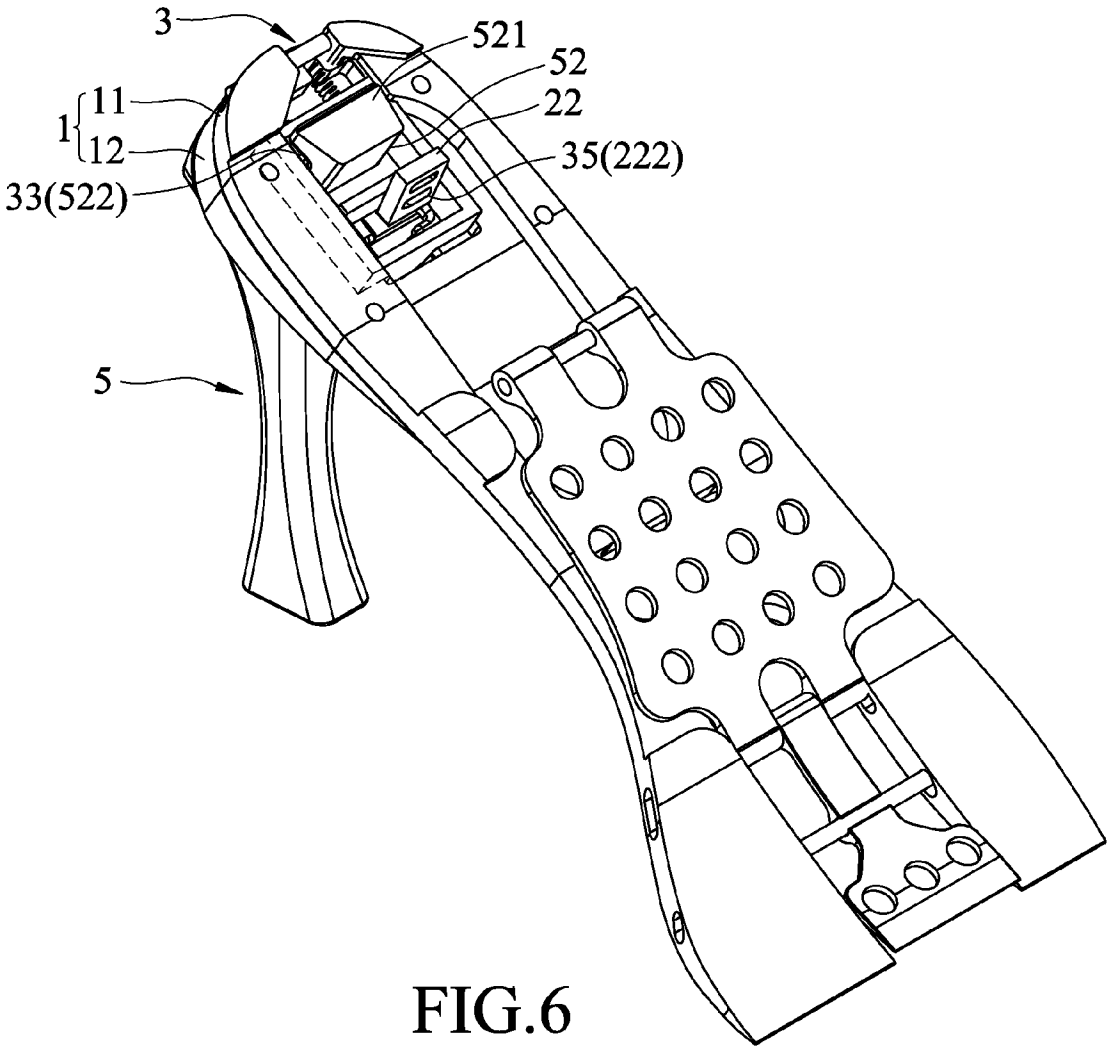
FIG. 6 is a fragmentary perspective view of the embodiment, illustrating the engaging member of the actuating unit engaging a second positioning hole of the positioning member.

After the low heel member 4 is completely removed, with the actuating member 32 being continuously pushed, the user can extend the support part 52 of the high heel member 5 through the base seat 1. Then, as shown in FIGS. 5 and 6, the actuating member 32 is released, so that the frame body 31 is automatically biased by restoring forces of the resilient members 36 to move forwardly, thereby engaging removably the engaging member 35 of the actuating unit 3 with the second positioning hole 222 of the positioning member 22 and engaging removably the protrusion 33 of the actuating unit 3 with the coupling groove 522 of the high heel member 5 to secure the high heel member 5 to the shoe 9.

At this time, the top end face 522 of the support part 52 of the high heel member 5 is above the top surface 111 of the first base plate 11, the top end face 521 of the support part 52 of the high heel member 5 abuts against the abutment surface 211 of the movable plate 21, and the support part 52 pushes up the foot segment 212 of the movable plate 21 to convert the movable plate 21 from the low curvature position to the high curvature position, where the pivot shaft 23 is moved to abut against the rear ends 113 of the through holes 116.

With the above description, the advantages of the foot arch support device can be summarized in the following:

1. The movable plate 21 is movable relative to the first base plate 11 between the high curvature position and the low curvature position, so that the disclosure is able to achieve the object of appropriately supporting the foot arch. That is, the uncomfortable feeling when wearing the conventional high-heeled shoes can be alleviated using the disclosure.

2. Since the actuating member 32 of the actuating unit 3 is exposed under the base seat 1, the selected one of the low heel member 4 and the high heel member 5 can be conveniently installed or removed without taking off the shoe 9.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the interpretation so as to encompass all such modifications and equivalent arrangements.

What is claimed is:

1. A foot arch support device adapted to be connected to a bottom of a shoe, the shoe having a heel portion, a toe portion, and an arch portion that is between the heel portion and the toe portion, said foot arch support device comprising:

a base seat including a first base plate, and a second base plate that is disposed under said first base plate, and that is adapted to be adjacent to the heel portion of the shoe, said first base plate having a top surface that is opposite to said second base plate;

a movable unit including a movable plate that is connected to said first base plate, that has an abutment surface facing said top surface of said first base plate, and that is movable relative to said first base plate between a high curvature position, where said abutment surface is away from said top surface of said first base plate, and a low curvature position, where said abutment surface abuts against said top surface of said first base plate;

a heel unit including a high heel member and a low heel member, a selected one of said high heel member and said low heel member being removably coupled to a bottom of said base seat, and having a heel part, and a support part extending from a top end of said heel part and having a top end face, when said low heel member is coupled to said bottom of said base seat, said movable plate of said movable unit is at the low curvature position, when said high heel member is coupled to said bottom of said base seat, said top end face of said support part of said high heel member abuts against said abutment surface of said movable plate, and said movable plate is pushed by said support part of said high heel member to the high curvature position; and an actuating unit disposed on said base seat, adapted to be adjacent to the heel portion of the shoe, and operable for permitting removal of the selected one of said high heel member and said low heel member from the bottom of said base seat.

2. The foot arch support device as claimed in claim 1, wherein:

said first base plate has a first recessed portion, a second recessed portion, and a front end portion that are sequentially arranged toward a front end of said first base plate, said top surface being formed on said first recessed portion, said front end portion being formed with a U-shaped opening; and said movable plate further has a heel segment, an arch segment, and a toe segment that are sequentially arranged toward a front end of said movable plate, said arch segment pivotally interconnecting said heel segment and said toe segment, said toe segment being received in said U-shaped opening of said front end portion of said first base plate, said heel segment and said arch segment engaging fittingly and respectively said first recessed portion and said second recessed portion of said first base plate when said movable plate is at the low curvature position.

3. The foot arch support device as claimed in claim 2, wherein:

said first base plate further has two through holes that are in spatial communication with said U-shaped opening; and said movable unit further includes a pivot shaft that extends through said toe segment of said movable plate and that has opposite ends extending respectively into said through holes.

4. The foot arch support device as claimed in claim 3, wherein each of said through holes has opposite front and rear ends.

5. The foot arch support device as claimed in claim 2, wherein said movable unit further includes a positioning member that is mounted to said heel segment of said movable plate, and that is formed with a first positioning hole and a second positioning hole arranged in a direction away from said heel segment.

6. The foot arch support device as claimed in claim 5, wherein said actuating unit is disposed movably in said second base plate of said base seat, and has a frame body, an actuating member that extends from a bottom end of said frame body through said second base plate, a spacer member that has opposite ends connected to an inner surface of said frame body, and an engaging member that protrudes from said spacer member, and that is removably engageable with one of said first and second positioning holes.

7. The foot arch support device as claimed in claim 6, wherein said actuating unit further has at least one resilient member connected between said second base plate and said frame body.

8. The foot arch support device as claimed in claim 7, wherein:

said support part of each of said high heel member and said low heel member further has a coupling groove; and said actuating unit further has a protrusion connected to said frame body, said protrusion engaging removably said coupling groove of said support part of said high heel member when said movable plate is at the high curvature position, said protrusion engaging removably said coupling groove of said support part of said low heel member when said movable plate is at the low curvature position.

9. The foot arch support device as claimed in claim 8, wherein, when said movable plate is at the low curvature position, said engaging member engages removably said first positioning hole, and said top end face of said support part of said low heel member is disposed below said top surface of said first base plate.

10. The foot arch support device as claimed in claim 8, wherein, when said movable plate is at the high curvature position, said engaging member engages removably said second positioning hole, and said top end face of said support part of said high heel member is disposed above said top surface of said first base plate.

* * * * *